US007409810B2

(12) United States Patent
Frievalt et al.

(10) Patent No.: US 7,409,810 B2
(45) Date of Patent: Aug. 12, 2008

(54) VERTICAL POUCH MAKING MACHINE AND METHOD OF MAKING POUCHES

(75) Inventors: Curt Frievalt, Green Bay, WI (US); Brian E. Kettner, Appleton, WI (US)

(73) Assignee: CMD Corporation, Appleton, WI (US)

( * ) Notice: Subject to any disclaimer, the term of this patent is extended or adjusted under 35 U.S.C. 154(b) by 0 days.

(21) Appl. No.: 11/537,955

(22) Filed: Oct. 2, 2006

(65) Prior Publication Data

US 2007/0095021 A1 May 3, 2007

Related U.S. Application Data

(62) Division of application No. 10/834,578, filed on Apr. 27, 2004, now Pat. No. 7,191,575.

(51) Int. Cl.
*B65B 61/18* (2006.01)
*B65B 9/06* (2006.01)

(52) U.S. Cl. ..... 53/412; 53/451; 53/133.4; 53/139.2; 53/551; 53/371.3; 493/248; 493/267; 493/308

(58) Field of Classification Search ..... 53/412, 53/451, 133.4, 139.2, 551, 371.3, 371.5, 53/371.6; 493/248, 267, 308, 296, 274
See application file for complete search history.

(56) References Cited

U.S. PATENT DOCUMENTS 1,944,147 A 1/1934 Aldrich
2,872,762 A * 2/1959 Dreeben ..... 53/451
3,426,499 A * 2/1969 Paige ..... 53/451
3,548,563 A 12/1970 Leasure
3,879,917 A 4/1975 Bassendale et al.
4,077,308 A 3/1978 Scully
4,109,792 A 8/1978 Greenawalt et al.
4,576,588 A * 3/1986 Umeda et al. ..... 53/551
4,604,854 A 8/1986 Andreas
4,727,709 A 3/1988 Zieke et al.
4,745,731 A * 5/1988 Talbott et al. ..... 53/451
5,014,499 A 5/1991 Boeckmann
5,570,569 A 11/1996 Masuda
5,930,983 A 8/1999 Terminella et al.
6,428,457 B1 * 8/2002 Fukuda et al. ..... 53/551
6,519,922 B1 2/2003 Matheyka et al.
6,679,034 B2 1/2004 Kohl et al.
6,691,491 B2 * 2/2004 Terminella et al. ..... 53/133.4
6,722,106 B2 4/2004 Bartel et al.
6,751,932 B1 * 6/2004 Matthews ..... 53/412
6,826,892 B2 12/2004 Basque et al.

* cited by examiner

*Primary Examiner*—Stephen F Gerrity
(74) *Attorney, Agent, or Firm*—George R. Corrigan

(57) ABSTRACT

A vertical form fill and seal continuous pouch machine includes a forming tube having a cross section area of CA is disclosed. A film tube is continuously formed about the forming tube and fed downward. A horizontal sealing assembly includes at least one pair of opposing sealing bars that make horizontal seals on the film, thereby forming pouches. The horizontal seals are formed in a horizontal sealing zone, and the vertical distance from a lower end of the forming tube to the center of the horizontal sealing zone is a transition distance that is (in inches) preferably no more than 0.5 multiplied by the cross-section area (in sq inches).

8 Claims, 2 Drawing Sheets

VERTICAL POUCH MAKING MACHINE AND METHOD OF MAKING POUCHES

RELATED APPLICATIONS

This is a divisional application of, and claims the benefit of the filing date of, U.S. patent application Ser. No. 10/834,578, filed on Apr. 27, 2004, now U.S. Pat. No. 7,191,575.

FIELD OF THE INVENTION

The present invention relates generally to the art of vertical pouch machines. More specifically, it relates to vertical form fill seal machines, wherein pouches are formed from a continuously moving film.

BACKGROUND OF THE INVENTION

Vertical form fill and seal continuous pouch machines are known in the art. Generally, they receive a continuous film and form the film into a film tube about a forming tube. The forming tube typically has a circular cross section, although other cross sections have been used.

The film is continuously fed around the forming tube and sealed vertically to form the film tube. The vertical seal is typically a lap seal or a fin seal.

Forming tubes can include ploughs or tucker bars to from creases that can be used to form gussets, to make stand-up pouches. The plough or tucker bar applies tension in an inward direction creasing the film tube. Forming plates may be provided on either side of the plough, applying tension in an outward direction. Two ploughs centered about a single tucker bar will form a "W" shaped gusset. The ploughs and tucker bars may be fixed in one location, such as at the bottom of the forming tube, or moveable in any direction. Examples of a tucker bar and forming plates may be seen in U.S. Pat. No. 6,679,034, hereby incorporated by reference. Tucker bars (and forming plates) may be used on a single side of the bag, forming one gusset, or on opposing sides, forming two gussets. Forming tube assemblies may be changed out to form bags of other sizes. Another prior art machine is shown in U.S. Pat. No. 6,691,491, hereby incorporated by reference.

After the film tube passes the forming tube and tucker bar(s) it moves vertically downward to a sealing zone. Seal bars intermittently create a horizontal seal. The seal bars may be rotary, and can be in pairs to increase machine speed. An example of seal bars is given in U.S. Pat. No. 6,519,922, hereby incorporated by reference.

The horizontal seal forms the top seal of the pouch below the seal, and the bottom of the pouch above the seal. After the seal is formed a scale or other input device drops a predetermined amount of product through the forming tube. At the same time the film tube is advancing downward. When the subsequent seal is formed the product is below the sealing zone. The seal is formed, forming the top seal of the filled bag and the bottom seal of the bag above, thus sealing the product into the bag. Stripper bars, such as those shown in U.S. Pat. No. 6,519,922 may be used to help ensure the product is below the sealing zone when the seal is made.

There are other type of vertical bag machines that make other types of bags. For example, pillow bags are common. Other bag designs require other configurations of the vertical machine. It is desirable to change a production line from one type bag to another. This typically involved removing the forming tube and the horizontal seal assembly. A new forming tube is installed, and the seal assembly is rotated, then reinstalled. The changeover, particularly removing the horizontal seal assembly, can be lengthy, which is, of course, undesirable. Accordingly, a vertical form fill and seal continuous pouch machine that can readily be converted to make other style bags without removing the horizontal seal assembly is desirable.

Some pouches are made on a horizontal pouch machine. Horizontal machines are generally slower, but provide advantages, such as the ability to place zippers or other recloseable devices on the pouch. Zippers (as used herein zipper includes other recloseable devices) are difficult to provide on vertical form fill and seal continuous pouch machine because the zipper would be added vertically at the forming tube (for example where the vertical seal is made). However, the horizontal seal must seal the entire width, thus requiring sealing through the zipper. It is difficult to effectively seal through a zipper. Accordingly, a vertical form fill and seal continuous pouch machine that provides a zipper or recloseable device is desirable.

The length the product drops can affect the quality of the filled pouch. A lengthy drop can cause breakage if the product is weighty. Also, the product tends to spread out vertically as it drops, and a lengthy drop can increase the vertical spread. If the vertical spread is too great, the product can get caught in the seal, or get caught above the seal, and thus not fully filling the intended pouch. The drop length along the forming tube is dictated by the required height of the forming tube. The drop length from the forming tube to the seal zone is dependent on the width of the tube in the direction perpendicular to the horizontal seal direction. The film tube width must change from the width of the forming tube at the exit of the forming tube to zero at the seal zone, without stretching, tearing or deforming the film. Thus, the tube-seal drop length must be long enough to allow for a gradual transition in film tube width. Accordingly, a vertical form fill and seal continuous pouch machine that provides a short tube-seal drop length, yet allows for the needed transition to zero film tube width, is desirable.

Some prior art vertical form fill and seal machines use a non-circular forming tube with a long and a short axis. Such tubes are typically disposed with the long axis parallel to the cross-direction and the horizontal seal is formed perpendicular to the cross direction. While this has been necessary for certain designs, it unfortunately results in a transition from the film tube width being the long axis to zero, and a resulting long drop length. Accordingly, a vertical form fill and seal continuous pouch machine with the horizontal seal being perpendicular to the short axis of the forming tube is desirable.

Prior art film used in vertical form fill and seal continuous pouch machines is typically a laminate to accommodate various needs, such as printing graphics, sealing, and to provide a barrier for food freshness and/or and food safety. The inner surface of the film tube is a material that will seal to itself with heat, such as OPP or PET. A gusseted pouch formed with a "W" has 4 layers of film (each corresponding to a segment forming the "W"). Each segment has an inner and an outer surface. All four layers are typically sealed to one another. The two outside segments have the inner surface facing the inner surface of the inside segments. Thus, the two outer segments will seal to the two inner segments. However, the two inner segments have an outside surface facing one another. Thus, the inner segments do not seal to one another. The prior art overcame this problem by applying a coating that seals to the outer surface in certain locations. This allowed all four segments to be sealed, but added cost.

Accordingly, a vertical form fill and seal continuous pouch machine that seals a gusset without a need for coating the outer surface is desirable.

One problem with forming the gusset is the film can be difficult to crease without damaging the film. Accordingly, a vertical form fill and seal continuous pouch machine that provides for creasing the film without damaging it is desirable.

SUMMARY OF THE PRESENT INVENTION

According to one aspect of the invention a vertical form fill and seal continuous pouch machine includes a forming tube having a cross section area of CA sq. inches. A film tube is continuously formed about the forming tube and fed downward. A horizontal sealing assembly includes at least one pair of opposing sealing bars that make horizontal seals on the film, thereby forming pouches. The horizontal seals are formed in a horizontal sealing zone, and the vertical distance from a lower end of the forming tube to the center of the horizontal sealing zone is a transition distance that is (in inches) preferably no more than 0.5 multiplied by the cross-section area (in sq inches).

The cross-section is generally an oval, elliptical, or has other shapes in various embodiments.

The forming tube cross section has a long axis of length L and a short axis of length S, and wherein the transition distance is no more than 4 multiplied by S, in other embodiments. A vertical seal forms the film tube, and the vertical seal is formed in a vertical plane that contains the long axis in another embodiment The vertical sealer is a film sealer or a lap sealer, and/or attaches a zipper in various embodiments. The zipper is intermittently knocked out, such as by a pneumatic punch on a shuttle in other embodiments.

The horizontal seals are formed in a plane with the long axis in another embodiment.

The film is moving in a machine direction as it approaches the forming tube, and a cross machine direction is in the plane of the film and perpendicular to the machine direction. The short axis is horizontal and parallel to the cross machine direction, and the long axis is horizontal and perpendicular to the short axis in other embodiments.

A hole-punch station intermittently punches at least two holes in the continuous film moving in the machine direction, and they are in a line extending in the cross machine direction in another embodiment. The holes are in a horizontal plane after the film tube has been formed. A pleat assembly forms a gusset, including at least a center fold and two side folds. The gusset is defined by at least two outer segments and at least two inner segments, wherein the at least two holes are disposed on the inner segments and aligned with one another. When the horizontal seals are made the outer segments are sealed to one another through the holes. One or more static ploughs may be mounted above the seal zone to form the gussets.

A film heater disposed along the film path prior to the film reaching the pleat assembly is provided in another embodiment.

The forming tube is removable and the sealing assembly is rotatable in yet other embodiments The sealing assembly includes a second pair of opposing seal bars, wherein the seal bars are rotating and the second pair of seal bars are 180 degrees out of phase with respect to the first pair in another embodiment. A stripper may be provided.

A controller times the seals, holes, and zipper knock-out in alternative embodiments.

Other principal features and advantages of the invention will become apparent to those skilled in the art upon review of the following drawings, the detailed description and the appended claims.

Figure 1:
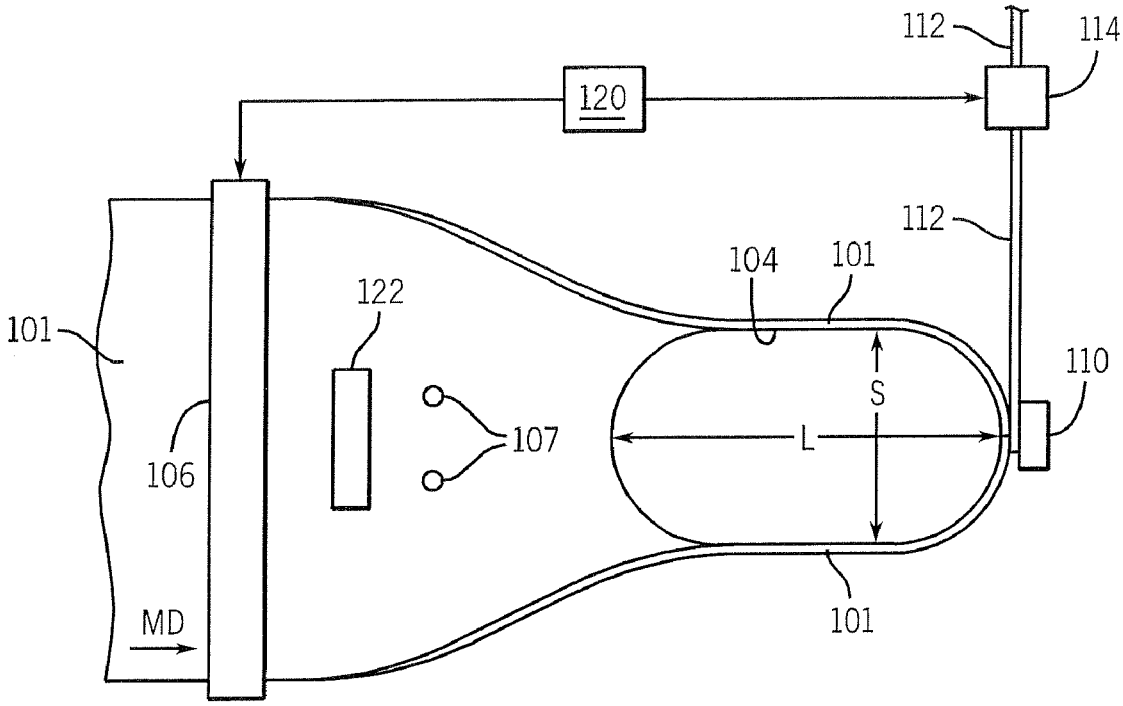
FIG. 1 is a top view of a forming tube being fed a continuous film and a zipper strip in accordance with the preferred embodiment.

Before explaining at least one embodiment of the invention in detail it is to be understood that the invention is not limited in its application to the details of construction and the arrangement of the components set forth in the following description or illustrated in the drawings. The invention is capable of other embodiments or of being practiced or carried out in various ways. Also, it is to be understood that the phraseology and terminology employed herein is for the purpose of description and should not be regarded as limiting. Like reference numerals are used to indicate like components.

DETAILED DESCRIPTION OF THE PREFERRED EMBODIMENTS

While the present invention will be illustrated with reference to a particular vertical form fill and seal continuous pouch machine, it should be understood at the outset that the invention can also be implemented with other machines, and other components.

Generally, the preferred embodiment is a vertical form fill and seal continuous pouch machine that has a number of features. Various embodiments use only one or several of these features. In accordance with the invention, a film 101 is fed to a forming tube 104 in a machine direction (arrow MD). (Directions are given with respect to the film as it approaches the forming tube, and machine direction is the direction the film travels, while cross direction is perpendicular to the machine direction, and in the plane of the film.) Prior to reaching the forming tube a hole punch assembly 106 punches holes 107 in the film. The holes are punched such that they will later be used to seal a gusset. If one gusset is to be sealed, two holes are punched, if 2 gussets are to be sealed, 4 holes are punched in the preferred embodiment. Other embodiments call for fewer or more holes.

The film is provided to forming tube 104, and film 101 is formed into a tube about the forming tube. The preferred embodiment provides an oval forming tube, having a long horizontal axis L and a short horizontal axis S in the preferred embodiment. The short axis S is parallel to the cross direction, and the long axis L is perpendicular to the short axis S. The fonning tube 104 must have a cross section capable of handling a desired amount of product, and a circumference set by the pouch circumference. The circumference in the preferred embodiment is 18.1 inches, and the cross sectional area is 20.9 sq inches in the preferred embodiment. The oval cross section desirably reduces product swirling as it is deposited. Elliptical, rectangular, or other shape tubes are provided in other embodiments.

The film edges are sealed using a vertical sealer 110 (also called a side or fin sealer), such as by a fin seal or a lap seal, in the preferred embodiment. The vertical sealer can be similar to prior art vertical or side sealers, and is preferably mounted near the bottom of forming tube 104.

A zipper is provided in the preferred embodiment. The zipper is fed on a continuous strip 112 to the vertical sealer, and sealed by the fin or vertical sealer to the film. However, zippers cause difficulty for the subsequent horizontal seals. Therefore, a pneumatic punch assembly 114 (or other device) is used to punch the zipper as it is being fed from the strip on an intermittent basis such that where the horizontal seals are made, the zipper has been knocked-out of the strip. The pneumatic punch is mounted on a shuttle that alternately moves with the strip, and then reverse direction to reset for the next punch. A controller controls 120 the sealing, punch, and shuttle to time then properly. Thus, the strip being fed to the vertical sealer and sealed with the side seal is a continuous strip that intermittently lacks a zipper.

Figure 2:
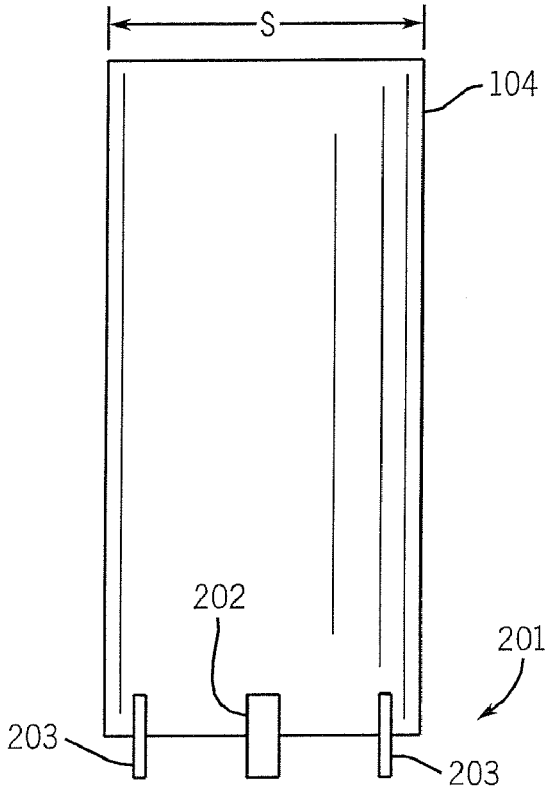
FIG. 2 is a side view of a forming tube and a pleat assembly in accordance with the preferred embodiment.
Figure 3:
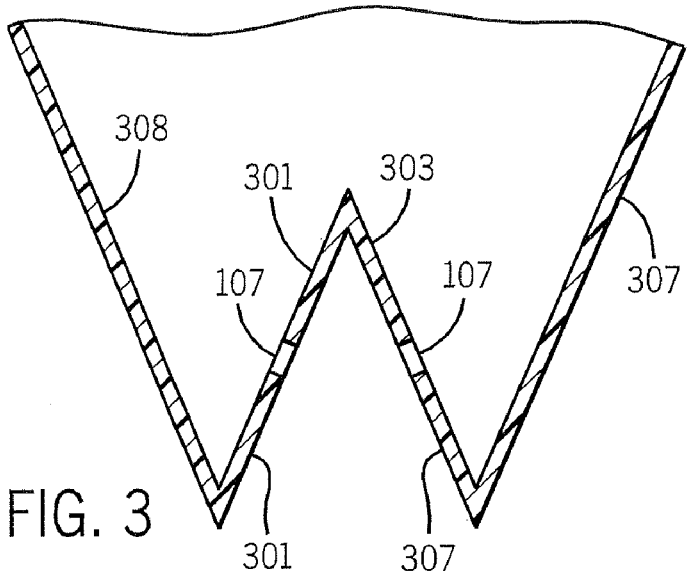
FIG. 3 is a schematic of a gusset in accordance with the preferred embodiment.

The forming tube includes a pleat assembly 201 (FIG. 2) that has one or two ploughs 202 (also called tucker bars) to form one or two gussets (one per side). Also, each plough may have two forming plates 203 associated therewith to help form the gusset. A heater 122 (FIG. 1) is provided to heat the film before it is folded, to obtain better folds, in the preferred embodiment. The heater heats the film before it reaches the forming tube, and heats strips of film corresponding to where the pleats will be located. The holes 107 punched in the film are positioned such that they oppose one another on inner segments 301 and 303 (FIG. 3) of the gusset. Thus, the inner surface of an outer segment 305 will be in contact with the inner surface of the other outer segment 307, when the horizontal seal is formed. The tucker bars and forming plates may be adjustable, and during production can be stationary or moving. The gussets have, in the preferred embodiment, at least three folds (a center fold and two side folds), and are defined by at least two outer segments and at least two inner segments.

The film, now formed into a tube with gussets, travels vertically (downward) to a horizontal sealing zone. In this zone the horizontal seals are formed that are the top of a preceding pouch and the bottom of a succeeding pouch. Thus, as the seals are formed, pouches are formed.

Figure 4:
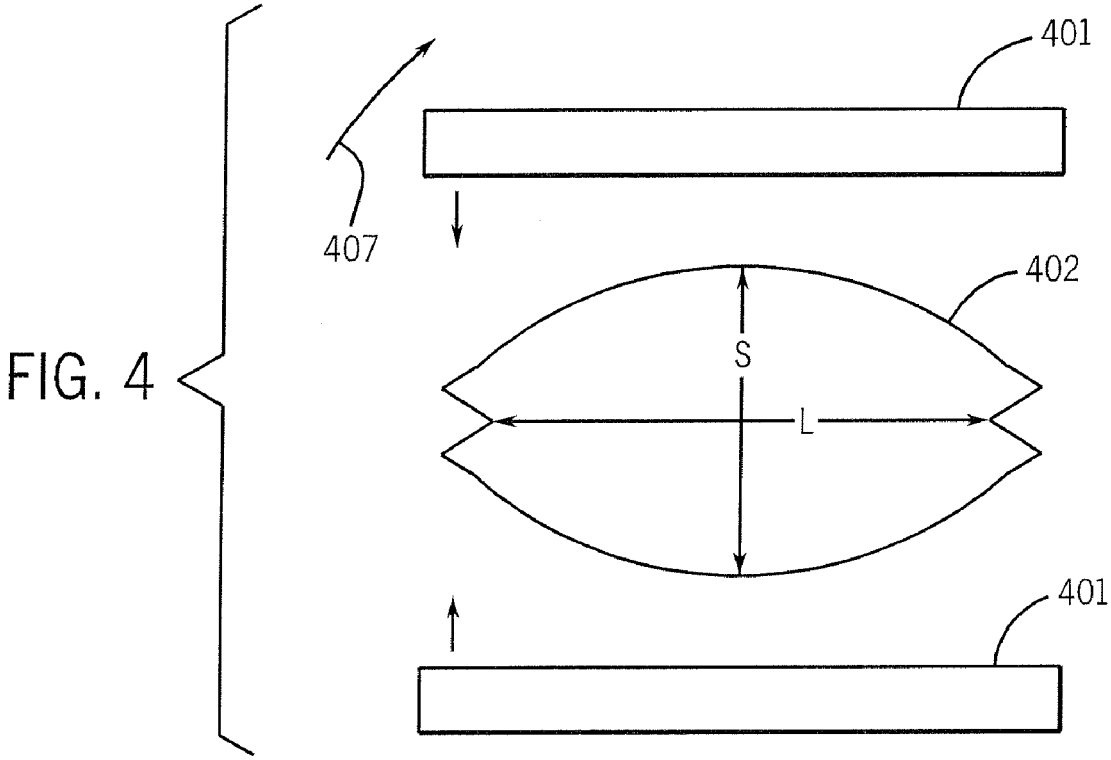
FIG. 4 is a top view of a sealing assembly in accordance with the preferred embodiment.

Turning to FIG. 4, the seal bars 401 (and the seals) extend the length of the pouch 402 (the dimension parallel to the long axis L). The punched holes 107 (described above) are positioned such that the inner surface of the outer segments of each gusset contact one another through the holes, and thus the two outer segments are sealed to one another, and the need for coating the outer surface at the gusset is overcome. The controller controls the punching and sealing such that the holes are in the proper location—preferably at the gussets and nowhere else.

There are preferably two pair of opposing sealing bars 401, which are preferably mounted to rotating arms, such as in U.S. Pat. No. 6,519,922, so that the seal bars match the speed of the film when the seal is made. Each pair is preferably 180 degrees out of phase from the other pair. A stripper for stripping product from the sealing zone is provided in the preferred embodiment.

As the film tube moves from the bottom of the forming tube to where the horizontal seal is formed, the width of the film tube transitions from the width of the forming tube to zero, where the width is the distance perpendicular to the direction of the horizontal seal. The vertical distance is called a transition distance.

Generally, a shorter transition length is better because it lessens product spreading and lessens the likelihood of product breaking. But, too short of a transition cause the film to stretch, tear or deform. According to the preferred embodiment, the transition length is decreased by decreasing the width of the forming tube (in a direction perpendicular to the horizontal seal direction). Thus, the oval forming tube has the short axis perpendicular to the seal direction. This allows the transition length to be about 11 inches, compared to a 17 length using a round tube that can handle comparable product. Various embodiments call for the transition length to be a function of the cross section of the forming tube, the perimeter of the tube, or a function of the width of the forming tube perpendicular to the horizontal seal direction. For example, in the preferred embodiment the ratio of the area in sq. inches to the transition length in inches is 2:1 or less. Also, the ratio of the ratio of the transition length to short axis is no more than 4:1. Also, the ratio of perimeter to transition length is no more than 2:1. One embodiment provides the following measurements and ratios, for a transition length of 11 inches, an area of 20.9 for a ratio of 20.9:11, a short axis of 3.18 for a ratio of 11:3.2, and a perimeter of 18.2 for a ratio of 18.2:11.

The various directions may be referenced to the machine and cross directions (as the film approaches the forming tube). The forming tube short axis is parallel to the cross direction. The forming tube long axis is perpendicular to the short axis. The horizontal seal is formed parallel to (in a plane with) the long axis, and perpendicular to the short axis and the cross direction.

The horizontal sealing mechanisms are mounted on a horizontal sealing assembly. According to one embodiment, the sealing assembly is mounted on a bearing and easily rotated (by removing pins, clamps, or bolts, e.g.). Rotating the assembly 90 degrees, as shown by arrow 407, allows pillow bags to be made using this machine. Also, the forming tube is changed, and a round tube is used, or a forming tube with the short axis perpendicular to the cross direction. Thus, the single machine may readily be used for both pillow type bags and stand up pouches.

Numerous modifications may be made to the present invention which still fall within the intended scope hereof. Thus, it should be apparent that there has been provided in accordance with the present invention a method and apparatus for a vertical form fill and seal continuous pouch machine that fully satisfies the objectives and advantages set forth above. Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

The embodiments of the invention in which an exclusive property or privilege is claimed are defined as follows:

1. A vertical form fill and seal continuous pouch machine, comprising:

a forming tube having a cross section with a long axis of length L and a short axis of length S, about which a film tube is continuously formed from a continuous film and from which the film tube is vertically fed downward;

a horizontal sealing assembly, including at least one pair of opposing sealing bars that impart horizontal seals to the film, thereby forming pouches, wherein the horizontal seal is formed in a plane with the long axis;

a hole-punch station which intermittently punches at least two holes in the continuous film which is moving in a machine direction, wherein the at least two holes are in a line extending in the cross machine direction, whereby the at least two holes are in a horizontal plane after the film tube has been formed; and a pleat assembly, disposed to impart a gusset, including at least three folds, including a center fold and two side folds, whereby the gusset is defined by at least two outer segments and at least two inner segments, wherein the at least two holes are disposed on the inner segments and aligned with one another; and wherein the horizontal seals are disposed such that the outer segments are sealed to one another through the at least two holes.

2. The vertical form fill and seal continuous pouch machine of claim 1 wherein the cross-section is generally an oval.

3. The vertical form fill and seal continuous pouch machine of claim 2, wherein a vertical sealer is disposed to impart a vertical seal to form the film tube, wherein the vertical seal is formed in a vertical plane that contains the long axis.

4. The vertical form fill and seal continuous pouch machine of claim 2, wherein the film is moving in a machine direction as it approaches the forming tube, and a cross machine direction is in the plane of the film and perpendicular to the machine direction, and wherein the short axis is horizontal and parallel to the cross machine direction, and the long axis is horizontal and perpendicular to the short axis.

5. The vertical form fill and seal continuous pouch machine of claim 2, further comprising a knock-out module that intermittently removes a portion of a the zipper from the a continuously moving strip.

6. The vertical form fill and seal continuous pouch machine of claim 1, wherein the cross-section is generally an ellipse.

7. A method of continuously forming, filling and sealing pouches, comprising:

continuously feeding a film to a forming tube;

continuously forming a tube of film having a cross section with a long axis of length L and a short axis of length S, and feeding the film tube vertically downward;

intermittently punching at least two holes in the continuously fed film which is moving in a machine direction, wherein the at least two holes are punched to be in a line extending in the cross machine direction, whereby the at least two holes are in a horizontal plane after the film tube has been formed;

making a horizontal seal on the film as the film moves, wherein the horizontal seal is made in a horizontal sealing zone wherein the horizontal seal is formed in a plane with the long axis;

dropping a product into the film tube;

making a subsequent horizontal seal on the film as the film moves, wherein the horizontal seal is made in the horizontal sealing zone to seal the pouch;

imparting a gusset, including at least three folds, including a center fold and two side folds, whereby the gusset is defined by at least two outer segments and at least two inner segments, wherein the at least two holes are disposed on the inner segments and aligned with one another; and wherein the horizontal seals are disposed such that the outer segments are sealed to one another through the at least two holes.

8. A vertical form fill and seal continuous pouch machine, comprising:

means for continuously feeding a film to a forming tube;

means for continuously forming a tube of film having a cross section with a long axis of length L and a short axis of length S, and feeding the film tube vertically downward;

means for making a horizontal seal on the film as the film moves, wherein the horizontal seal is made in a horizontal sealing zone wherein the horizontal seal is formed in a plane with the long axis;

means for dropping a product into the film tube;

means for making a subsequent horizontal seal on the film as the film moves, wherein the horizontal seal is made in the horizontal sealing zone to seal the pouch;

means for intermittently punching at least two holes in the continuous film which is moving in a machine direction, wherein the at least two holes are in a line extending in the cross machine direction, whereby the at least two holes are in a horizontal plane after the film tube has been formed; and means for imparting a gusset, including at least three folds, including a center fold and two side folds, whereby the gusset is defined by at least two outer segments and at least two inner segments, wherein the at least two holes are disposed on the inner segments and aligned with one another; and wherein the horizontal seals are disposed such that the outer segments are sealed to one another through the at least two holes.

* * * * *